United States Patent [19]

Shih

[11] Patent Number: 5,048,415

[45] Date of Patent: Sep. 17, 1991

[54] STAMP COMBINATION

[76] Inventor: Shiny Shih, No. 77, Lane 101, Nan Yuan St., Tainan, Taiwan

[21] Appl. No.: 531,231

[22] Filed: May 31, 1990

[51] Int. Cl.[5] ..... B41J 27/00

[52] U.S. Cl. ..... 101/103; 101/333; 101/405; 101/379

[58] Field of Search ..... 101/103, 109, 327, 333, 101/405, 406, 368, 379, 125

[56] References Cited

U.S. PATENT DOCUMENTS

| | | | |
|---|---|---|---|
| 2,839,994 | 6/1958 | Haag | 101/109 |
| 2,899,895 | 8/1959 | Tannery | 101/405 |
| 3,442,209 | 5/1969 | Funahashi | 101/380 |
| 3,832,947 | 9/1974 | Funahashi | 101/327 |
| 4,594,943 | 6/1986 | Nellesheim et al. | 101/327 |
| 4,676,162 | 6/1987 | Phipps, Sr. et al. | 101/405 |
| 4,939,990 | 7/1990 | Inaguma et al. | 101/109 |

*Primary Examiner*—Edgar S. Burr
*Assistant Examiner*—Ren Yan
*Attorney, Agent, or Firm*—Zarley, McKee, Thomte, Voorhees and Sease

[57] ABSTRACT

A stamp has a housing and a stem provided on the housing. A lid is provided on the stem. A holder is connected to the lid by a rod and is receivable in the housing. A number of grooves are formed in a bottom of a lower casing. An upper casing and the lower casing are insertable into the holder. A number of blocks each has a letter, a numeral or a symbol carved on a lower surface. The blocks are disposed and arranged in the grooves. When the lid is pressed downward, the blocks are caused to move downward to stamp a surface to be stamped.

5 Claims, 6 Drawing Sheets

STAMP COMBINATION

BACKGROUND OF THE INVENTION

The present invention relates to a stamp, and more particularly to a stamp combination.

Various kinds of stamps are widely used today. Generally, the letters, the margin and/or the patterns of the stamp are carved or engraved on a lower surface thereof and are not interchangeable.

The present invention has arisen to mitigate and/or obviate the afore-described disadvantages of the conventional stamp.

SUMMARY OF THE INVENTION

The primary objective of the present invention is to provide a stamp combination in which the letters and the margin are interchangeable and rearrangeable.

In accordance with one aspect of the invention, there is provided a stamp combination which has a housing and a stem provided on the housing. A lid is provided on the stem. A holder is connected to the lid by a rod and is receivable in the housing. A number of grooves are formed in a bottom of a lower casing. An upper casing and the lower casing are insertable into the holder. A number of blocks each has a letter, a numeral or a symbol carved on a lower surface. The blocks are disposed and arranged in the grooves. When the lid is pressed downward, the blocks are caused to move downward to stamp a surface to be stamped.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
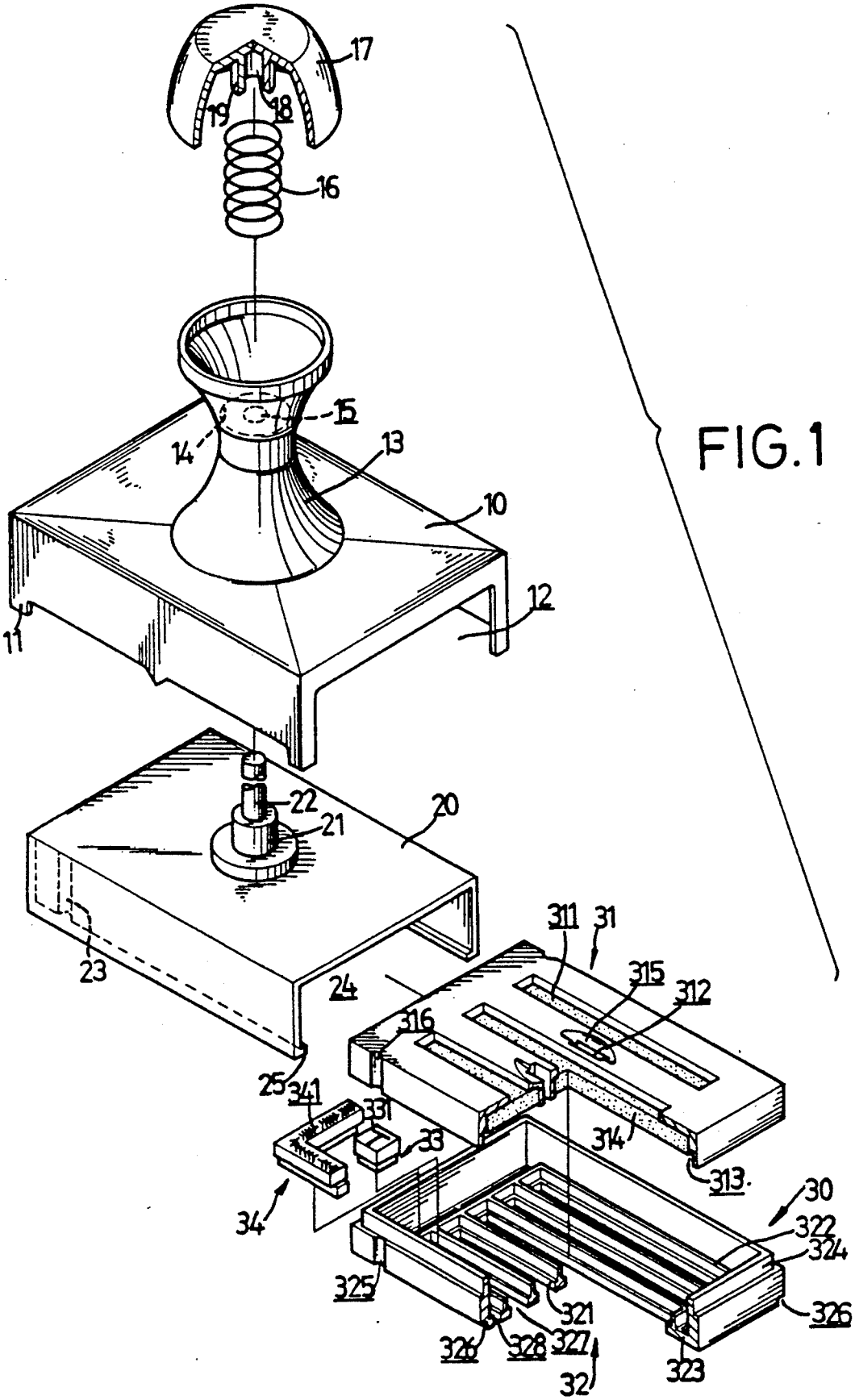
FIG. 1 is an exploded view of a stamp combination in accordance with the present invention.
Figure 2:
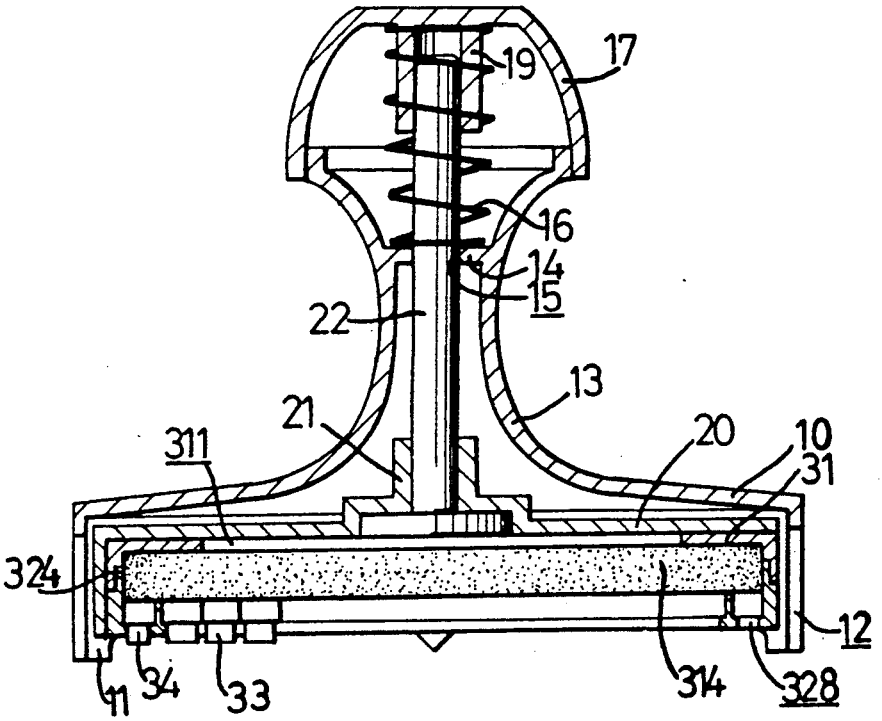
FIG. 2 is a cross sectional view of the stamp combination.

Referring to the drawings and initially to FIGS. 1 and 2, the stamp combination in accordance with the present invention comprises generally a housing 10, a holder 20, a base portion 30 and a plurality of blocks 33 and a strip 34 disposed and arranged in the base portion 30.

Four legs 11 are extended downward on the corners of the lower end of the housing 10 which is substantially a hollow rectangular parallelepiped with an open lower end. An opening 12 is formed in the front end of the housing 10. A stem 13 is integrally provided on the upper surface of the housing 10. A ring 14 which has a hole 15 is provided in a middle portion of the stem 13. A short cylinder 19 with a hole 18 is extended downward and inward from the upper plate of a lid 17 which has an open lower end. An upper end of a spring 16 embraces the outer surface of the short cylinder 19, and the lower end of the spring 16 contacts the upper surface of the ring 14. The inner peripheral surface of the lower portion of the lid 17 contacts the outer peripheral surface of the upper end of the stem 13 in a frictional manner such that the lid 17 may slide downward relative to the stem 13. The spring 16 as shown in FIG. 2 is neither compressed nor extended.

The shape of the holder 20 is similar to the housing 10, but has a reduced size so that the holder 20 can be received in the housing 10. A short tube 21 is integrally formed on an upper end of the holder 20. The upper end of a rod 22 is force-fitted in the hole 18 of the lid 17, and the lower end of the rod 22 is force-fitted in the short tube 21 so that the lid 17, the rod 22 and the holder 20 move in concert. An opening 24 is formed in the front end of the holder 20 and faces toward the opening 12 of the housing 10. A flange 25 is longitudinally formed on the lower end of each lateral side of the holder 20 and extends inward of the holder 20. A protrusion 23 is vertically formed in the inner surface of each side of the holder 20.

The base portion 30 includes an upper casing 31 and a lower casing 32. Three rectangular holes 311 are formed in the upper surface of the upper casing 31. A pair of apertures 312 are formed in the middle portion of the upper casing 31 and a depression 315 is formed in the upper casing 31 on one side of the upper end of each aperture 312. A peripheral recess 313 is formed in the inner and lower peripheral surface of the upper casing 31. A sponge or the like 314 is received in the upper casing 31. The ink may be added to the sponge 314 via the rectangular holes 311. A pair of recesses 316 are formed in the sides of the upper casing 31 corresponding to the protrusions 23 of the holder 20.

The lower casing 32 has a plurality of beams 321 longitudinally formed in a rectangular frame 322 so that a groove 327 is formed between every two adjacent beams 321. A recatangular frame 322 is connected to the inner and lower surface of the lower casing 32 by the connecting members 323 so that a peripheral gap 328 is formed therebetween. The beams 321 has an inverted T-shaped section so that a peripheral shoulder is formed between every two adjacent beams 321. A peripheral wall 324 is formed on top of the lower casing 32 and can be received and engaged in the peripheral recess 313 of the upper casing 31. A pair of notches 326 are longitudinally formed in the lower and outer sides of the lower casing 32 and are slidably engageable with the flanges 25 of the holder 20. A pair of recesses 325 are formed in the sides of the lower casing 32 corresponding to the protrusions 23 of the holder 20 and are aligned with the recesses 316 of the upper casing 31. When the peripheral wall 324 of the lower casing 32 is received and egaged in the peripheral recess 313 of the upper casing 31, the upper casing 31 and the lower casing 32 are insertable into the holder 20 through the opening 24 thereof until the protrusions 23 of the holder 20 are engaged with the respective recesses 316, 325 of the casings 31, 32.

A plurality of blocks 33 each has a letter 331, a numeral or a symbol printed on the upper surface thereof and has an identical letter, numeral or symbol carved on the lower surface thereof. There is only one block 33 shown in FIG. 1 for illustration purposes. The blocks 33 are made of materials that absorb ink, such as spongy materials. A shoulder is formed on the middle portion of the outer peripheral surface of each block 33 so that the blocks 33 can be arranged and supported in the grooves 327 between the beams 321 of the lower casing 32. As shown in FIG. 2, the lower part of the blocks 33 extend through the beams 321 so that the lower surfaces of the blocks 33 are located lower than the lower surface of the lower casing 32. The blocks 33 can be easily arranged in series between the beams 321 by referring to the printed letters 331, numerals or symbols provided on the upper surfaces thereof.

A strip 34 is substantially rectangular and only a segment of the corner area is shown in FIG. 1. The strip 34 has a shoulder formed on the middle portion of the outer and the inner peripheral surfaces thereof so that the strip 34 can be supported between the rectangular frame 322 and the lower casing 32 and extends in the peripheral gap 328. A margin 341 of predetermined pattern is printed on the upper surface of the strip 34 and an identical margin is carved on the lower surface of the strip 34. The lower surface of the strip 34 is located below the lower surface of the lower casing 32. The upper surfaces of the blocks 33 and the strip 34 contact and bear against the lower surface of the sponge 314 so as to absorb the ink from the sponge 314.

When the lid 17 is not pressed downward, the lower surfaces of the blocks 33 and the strip 34 are located higher than the bottom of the legs 11, as clearly shown in FIG. 2. When the stamp combination in accordance with the present invention is disposed upon a paper or the like to be stamped, the lid 17 is pressed downward by a user, the holder 20 and the base portion 30 are caused to move downward by the rod 22 so that the lower surfaces of the blocks 33 and the strip 34 are caused to move downward beyond the bottom surfaces of the legs 11 and so that the paper can be stamped by the carved letters, numerals or symbols on the lower surfaces of the blocks 33 and the strip 34. When the lid 17 is released, the holder 20 and the base portion 30 are caused to move upward by the spring 16.

Figure 6:
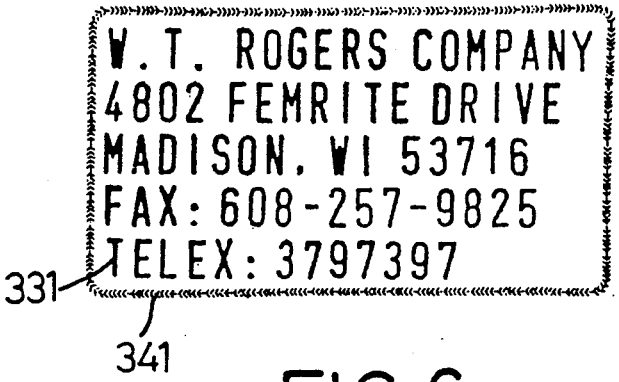
FIGS. 6, 7 and 8 are plane views illustrating three stamps stamped by the stamp combination in accordance with the present invention.

Referring next to FIG. 6, the stamp which is substantially rectangular can be stamped by the stamp combination as shown in FIGS. 1 and 2.

Figure 3:
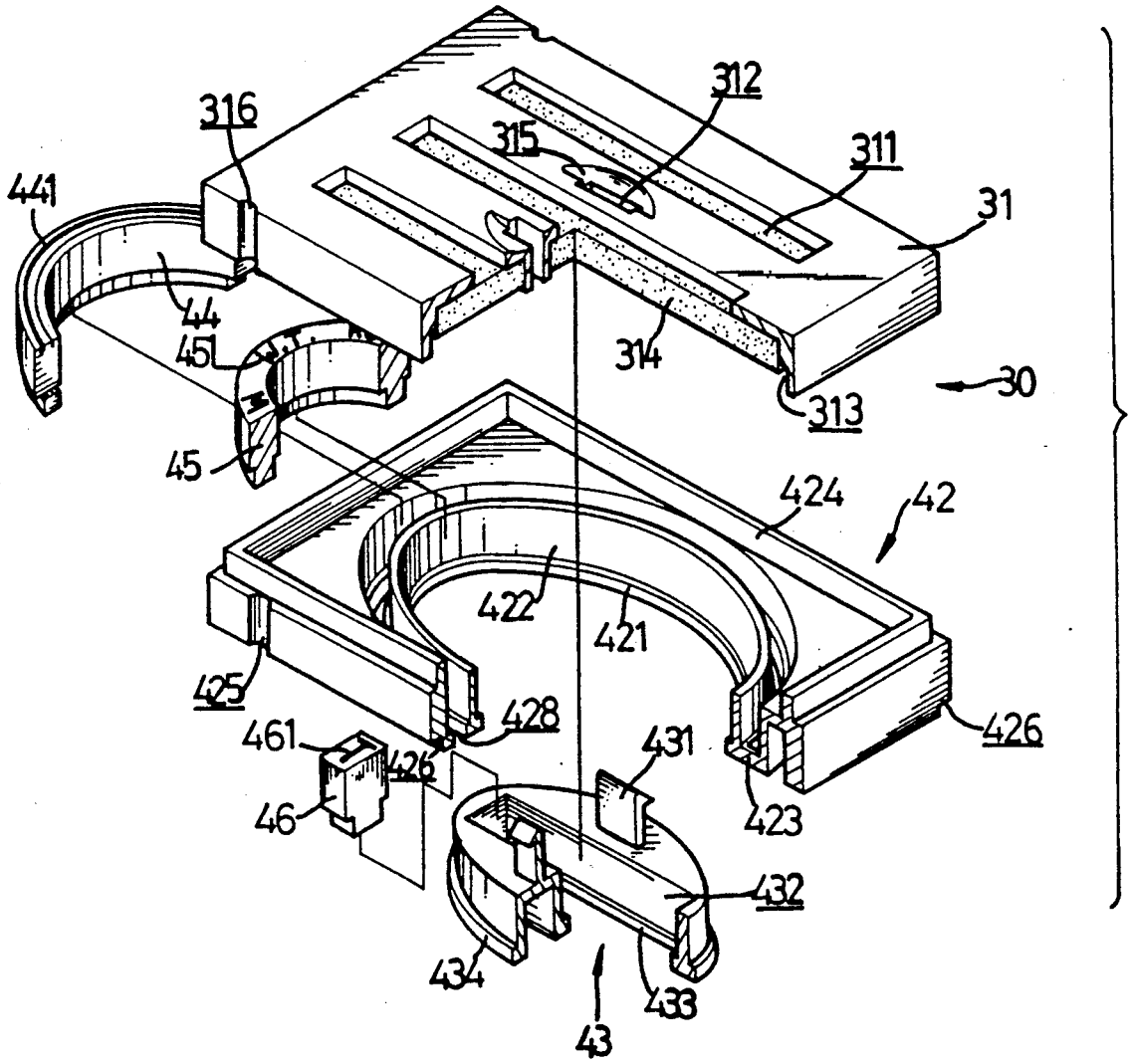
FIG. 3 is an exploded view of another embodiment of the base portion of the stamp combination.
Figure 4:
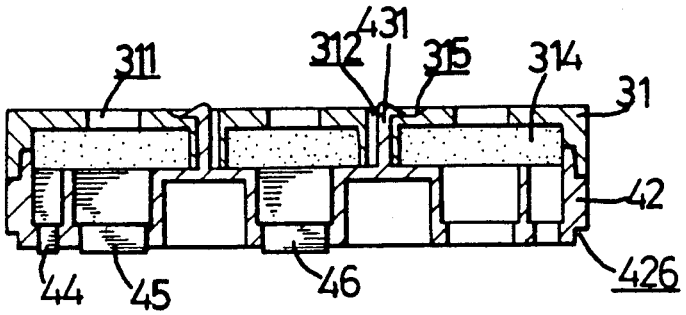
FIG. 4 is a cross sectional view of the base portion of FIG. 3.

Referring next to FIGS. 3 and 4, illustrated is another embodiment of the base portion 30, in which the upper casing 31 is identical to that is shown in FIGS. 1 and 2. The lower casting 42 has an elliptical frame 422 which is connected to the inner and lower surface of the lower casing 42 by the connecting members 423 so that an elliptical gap 428 is formed therebetween. An elliptical flange 421 extends inward from the lower and inner surface of the elliptical frame 422. A peripheral wall 424 is formed on top of the lower casing 42 and can be received and engaged in the peripheral recess 313 of the upper casing 31. A pair of notches 426 are longitudinally formed in the lower and outer sides of the lower casing 42 and are slidably engageable with the flanges 25 of the holder 20. A pair of recesses 425 are formed in the sides of the lower casing 42 corresponding to the protrusions 23 of the holder 20 and are aligned with the recesses 316 of the upper casing 31. When the peripheral wall 424 of the lower casing 32 is received and engaged in the peripheral recess 313 of the upper casing 31, the upper casing 31 and the lower casing 42 are insertable into the holder 20 through the opening 24 thereof until the protrusions 23 of the holder 20 are engaged with the respective recesses 316, 425 of the casings 31, 42.

A seat 43 has a pair of hooks 431 provided on the upper surface thereof. The hooks 431 can be inserted through the apertures 312 of the upper casing 31 until the upper ends of the hooks 431 are received in the respective depressions 315 of the upper casing 31 so that the seat 43 can be coupled to the upper casing 31. A rectangular hole 432 is formed in the seat. A peripheral flange 433 extends inward from the inner and lower surface of the hole 432. An elliptical flange 434 extends outward from the outer and lower surface of the seat 43. An elliptical strip 44 which has a T-shaped cross section has a margin 441 printed on the upper surface thereof and has an identical margin carved on the lower surface thereof. The strip 44 is received in the gap 428. Another elliptical strip 45 has letters 451 or symbols printed on the upper surface thereof and has identical letters or symbols carved on the lower surface thereof. The strip 44 is received between the elliptical frame 422 and the seat 43 and is supported in place by the flanges 421 and 434. A plurality of blocks 46 each has a letter 461, a numeral or a symbol printed on the upper surface thereof and has an identical letter, numeral or symbol carved on the lower surface thereof. The blocks 46 are arranged and supported in place in the hole 432 by the flange 433. The upper surfaces of the strips 44, 45 and of the blocks 46 contact and bear against the lower surface of the sponge 314.

Figure 7:
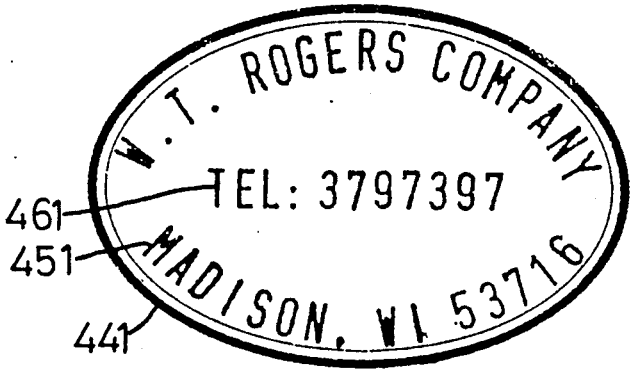

Referring next to FIG. 7, the stamp which is substantially elliptical can be stamped by the stamp combination as shown in FIGS. 3 and 4.

Figure 5:
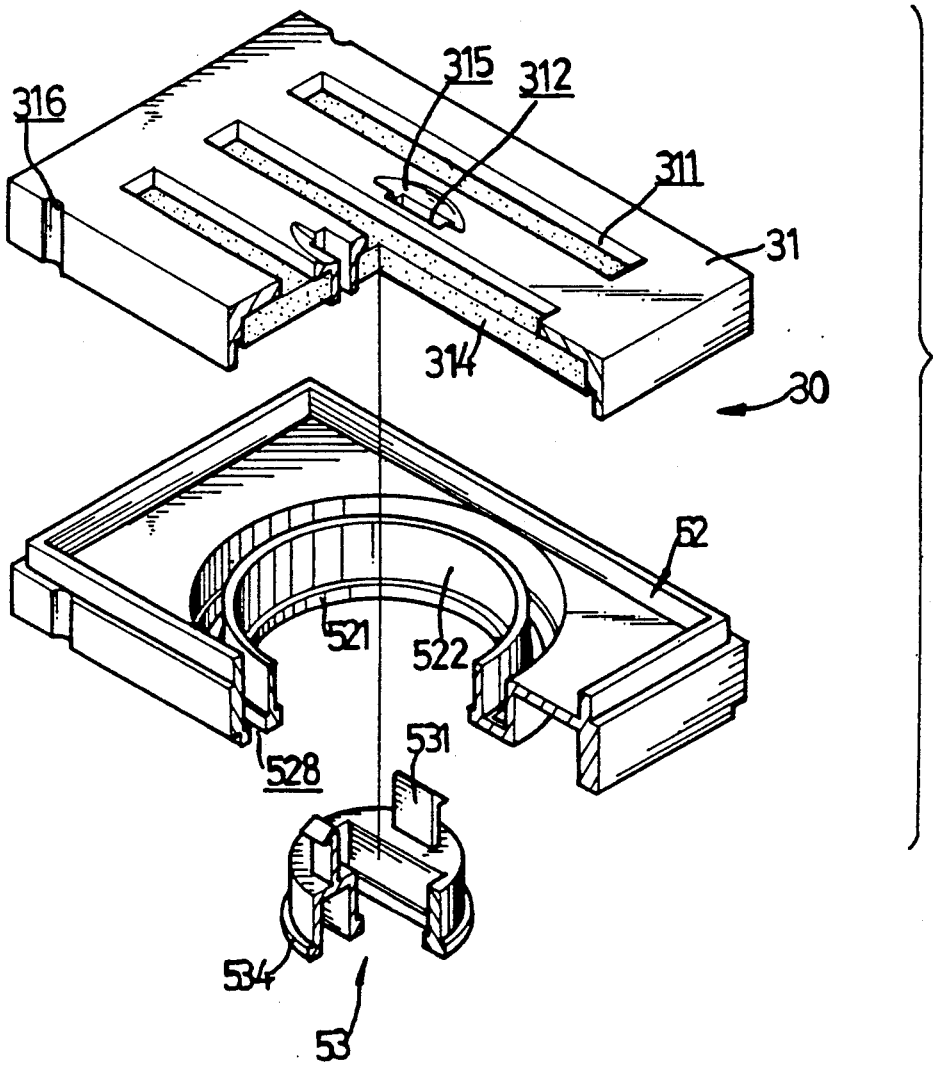
FIG. 5 is an exploded view similar to FIG. 3, illustrating still another embodiment of the present invention.

Referring next to FIG. 5, illustrated is still another embodiment of the base portion 30, in which the upper casing 31 is identical to that is shown in FIGS. 1 to 4. The lower casing 52 and the seat 53 are similar in configuration to the lower casing 42 and the seat 43 which are shown in FIGS. 3 and 4, except that the frame 522, the gap 528, the flange 521, the seat 53 and the flange 534 are substantially circular. The seat 53 can be coupled to the upper casing 31 by the hooks 531. Two strips (not shown) are similar in configuration to the strips 44, 45, except that the shape is circular.

Figure 8:
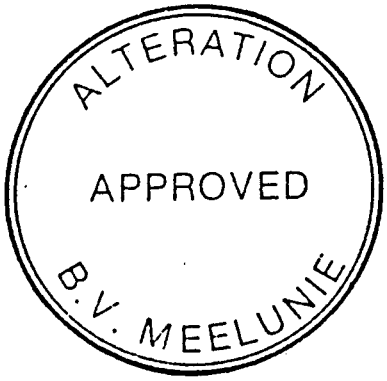

Referring next to FIG. 8, the stamp which is substantially circular can be stamped by the stamp combination as shown in FIG. 5.

Accordingly, letters, numerals and symbols can be interchanged and rearranged with the stamp combination in accordance with the present invention. The user can design any kind of stamps by his own will.

I claim:

1. A stamp combination comprising:

a housing which is hollow and which is substantially a rectangular parallelepiped having an open bottom, a stem integrally provided on said housing, a lid provided on top of said stem and slidable vertically relative to said stem, a spring bearing between said stem and said lid for biasing said lid upward relative to said stem;

a holder including a pair of side walls and having a shape similar to said housing, said holder being smaller than said housing so that said holder is receivable in said housing, a rod being vertically disposed in said stem and being connected between said lid and said holder so that said lid, said rod and said holder move in concert, an opening being formed in the front end of said holder, a first flange being longitudinally formed on a lower end of each side wall of said holder and extending inwards of said holder;

a base portion including an upper casing and a lower casing, a plurality of holes being formed in the upper surface of said upper casing, a spongy material being received in said upper casing, ink being added to said spongy material via said holes; a plurality of grooves being formed in the bottom of said lower casing; said upper casing and said lower casing being insertable into said holder through said opening of said holder, and being supported in place by said first flanges of said holder;

a plurality of blocks each having a letter, a numeral or a symbol printed on an upper surface thereof and having an identical letter, numeral or symbol carved on a lower surface thereof, said blocks being interchangeably disposed and arranged in said grooves, a lower part of said blocks extending beyond said grooves so that a lower surface of each block is lower than a lower surface of said lower casing, said upper surfaces of said blocks contacting said spongy material so as to absorb said ink therefrom, said blocks being easily arrangeable in series in said grooves by referring to said printed letters, numerals or symbols provided on said upper surfaces of said blocks;

said lower surfaces of said blocks being higher than a lower end of said housing when said lid is not pressed downward; and said holder and said base portion being caused to move downward by said rod so that said lower surfaces of said blocks are caused to move downward beyond said lower end of said housing and so that said carved letters, numerals or symbols provided on said lower surfaces of said blocks contact a surface to be stamped when said lid is pressed downward by a user.

2. A stamp combination according to claim 1, wherein a peripheral recess is formed in an inner and lower peripheral surface of said upper casing, a peripheral wall is formed on top of said lower casing and can be received and engaged in said peripheral recess of said upper casing, a protrusion is formed in an inner surface of each lateral side of said holder, a first recess is formed in each lateral side of said upper casing, a second recess is formed in each lateral side of said lower casing; and when said peripheral wall is engaged in said peripheral recess, said upper casing and said lower casing being insertable into said holder until said protrusions of said holder are engaged with said recesses of said upper casing and said lower casing so that said upper casing and said lower casing are stably retained in said holder.

3. A stamp combination according to claim 1, wherein a plurality of beams are longitudinally formed in a rectangular frame in parallel, said grooves are formed between every two adjacent beams, at least two first connecting members connecting said rectangular frame to said lower casing so that a peripheral gap is formed between said rectangular frame and said lower casing, said beams having an inverted T-shaped section so that a first shoulder is formed on each side of each beam, a second shoulder is formed on a middle portion of an outer peripheral surface of each block so that said blocks are supported in place by engagement between said first shoulder and said second shoulder, a first strip which is rectangular and has a third shoulder formed on a middle portion of an inner peripheral surface thereof so that said first strip can be supported in said peripheral gap by engagement between said third shoulder and said first shoulder, a first margin of predetermined pattern printed on an upper surface of said first strip and an identical first margin carved on a lower surface of said first strip, said lower surface of said first strip being lower than said lower surface of said lower casing, and said lower surface of said first strip being caused to move downward beyond said lower end of said housing when said lid is pressed downward so that said carved first margin of said first strip contacts said surface to be stamped.

4. A stamp combination comprising:

a housing which is hollow and which is substantially a rectangular parallelepiped having an open bottom, a stem integrally provided on said housing, a lid provided on top of said stem and slidable vertically relative to said stem, a spring bearing between said stem and said lid for biasing said lid upward relative to said stem;

a holder including a pair of side walls and having a shape similar to said housing, said holder being smaller than said housing so that said holder is receivable in said housing, a rod being vertically disposed in said stem and being connected between said lid and said holder so that said lid, said rod and said holder move in concert, an opening being formed in the front end of said holder, a first flange being longitudinally formed on a lower end of each side wall of said holder and extending inwards of said holder;

a base portion including an upper casing and a lower casing, a plurality of holes being formed in the upper surface of said upper casing and a pair of apertures being formed in a middle portion of said upper casing, a spongy material being received in said upper casing, ink being added to said spongy material via said holes; said upper casing and said lower casing being insertable into said holder through said opening of said holder, and being supported in place by said first flanges of said holder;

at least two connecting members connecting an elliptical frame to the inner and lower surface of said lower casing so that an elliptical gap is formed between said elliptical frame and said lower casing; an elliptical flange extending inward from a lower and inner surface of said elliptical frame; a seat having a pair of hooks provided on an upper surface thereof, said hooks being insertable through said apertures of said upper casing so as to hook said seat to said upper casing; a rectangular hole being formed in said seat, a shoulder being formed on each inner side of said rectangular hole;

a plurality of blocks each having a letter, a numeral or a symbol printed on an upper surface thereof and having an identical letter, numeral or symbol carved on a lower surface thereof, said blocks being interchangeably disposed and arranged in said rectangular hole, a lower part of said blocks extending beyond said rectangular hole so that a lower surface of each block is lower than a lower surface of said lower casing, said upper surfaces of said blocks contacting said spongy material so as to absorb said ink therefrom, said blocks being easily arrangeable in series in said rectangular hole by referring to said printed letters, numerals or symbols provided on said upper surfaces of said blocks;

a strip which is elliptical having a margin printed on an upper surface thereof and having an identical margin carved on a lower surface thereof, said strip being receivable in said elliptical gap, said lower surfaces of said blocks and said lower surface of said strip being higher than a lower end of said housing when said lid is not pressed downward; and said holder and said base portion being caused to move downward by said rod so that said lower surfaces of said blocks and of said strip are caused to move downward beyond said lower end of said housing and so that said carved letters, numerals or symbols or margin provided on said lower surfaces of said blocks and said strip contact a surface to be stamped when said lid is pressed downward by a user.

5. A stamp combination comprising:

a housing which is hollow and which is substantially a rectangular parallelepiped having an open bottom, a stem integrally provided on said housing, a lid provided on top of said stem and slidable vertically relative to said stem, a spring bearing between said stem and said lid for biasing said lid upward relative to said stem;

a holder including a pair of side walls and having a shape similar to said housing, said holder being smaller than said housing so that said holder is receivable in said housing, a rod being vertically disposed in said stem and being connected between said lid and said holder so that said lid, said rod and said holder move in concert, an opening being formed in the front end of said holder, a first flange being longitudinally formed on a lower end of each side wall of said holder and extending inwards of said holder;

a base portion including an upper casing and a lower casing, a plurality of holes being formed in the upper surface of said upper casing and a pair of apertures being formed in a middle portion of said upper casing, a spongy material being received in said upper casing, ink being added to said spongy material via said holes; said upper casing and said lower casing being insertable into said holder through said opening of said holder, and being supported in place by said first flanges of said holder;

at least two connecting members connecting a frame which is substantially circular to the inner and lower surface of said lower casing so that a circular gap is formed between said circular frame and said lower casing; a circular flange extending inward from a lower and inner surface of said circular frame; a seat having a pair of hooks provided on an upper surface thereof, said hooks being insertable through said apertures of said upper casing so as to hook said seat to said upper casing; a rectangular hole being formed in said seat, a shoulder being formed on each inner side of said rectangular hole;

a plurality of blocks each having a letter, a numeral or a symbol printed on an upper surface thereof and having an identical letter, numeral or symbol carved on a lower surface thereof, said blocks being interchangeably disposed and arranged in said rectangular hole, a lower part of said blocks extending beyond said rectangular hole so that a lower surface of each block is lower than a lower surface of said lower casing, said upper surfaces of said blocks contacting said spongy material so as to absorb said ink therefrom, said blocks being easily arrangeable in series in said rectangular hole by referring to said printed letters, numerals or symbols provided on said upper surfaces of said blocks;

a strip which is circular having a margin printed on an upper surface thereof and having an identical margin carved on a lower surface thereof, said strip being receivable in said circular gap, said lower surfaces of said blocks and said lower surface of said strip being higher than a lower end of said housing when said lid is not pressed downward; and said holder and said base portion being caused to move downward by said rod so that said lower surfaces of said blocks and of said strip are caused to move downward beyond said lower end of said housing and so that said carved letters, numerals or symbols or margin provided on said lower surfaces of said blocks and said strip contact a surface to be stamped when said lid is pressed downward by a user.

* * * * *